US007458922B2

(12) United States Patent
Pisciottano

(10) Patent No.: US 7,458,922 B2
(45) Date of Patent: Dec. 2, 2008

(54) STRETCHING APPARATUS AND ASSOCIATED METHOD

(76) Inventor: Maurice A. Pisciottano, 115 Trotters Ct., Venetia, PA (US) 15367

( * ) Notice: Subject to any disclaimer, the term of this patent is extended or adjusted under 35 U.S.C. 154(b) by 87 days.

(21) Appl. No.: 11/229,882

(22) Filed: Sep. 19, 2005

(65) Prior Publication Data

US 2007/0066465 A1 Mar. 22, 2007

(51) Int. Cl.
*A63B 26/00* (2006.01)
*A63B 23/08* (2006.01)

(52) U.S. Cl. ..... 482/142; 482/79; 482/907

(58) Field of Classification Search ..... 482/70, 482/79, 80, 100, 142, 145, 907
See application file for complete search history.

(56) References Cited

U.S. PATENT DOCUMENTS 1,531,670 A 3/1925 Levy
2,542,074 A 2/1951 Bierman
3,370,584 A 2/1968 Girten
3,430,956 A 3/1969 Borgeas
3,917,261 A * 11/1975 Small et al. ..... 482/8
4,807,874 A * 2/1989 Little ..... 482/80
4,815,732 A * 3/1989 Mahvi ..... 482/142
4,844,054 A 7/1989 Raemdonck
5,170,776 A * 12/1992 Pecheux ..... 601/29
5,203,321 A 4/1993 Donovan et al.
5,211,161 A * 5/1993 Stef ..... 601/5
5,215,511 A * 6/1993 Cheng ..... 482/121
5,518,482 A * 5/1996 Hsieh ..... 482/130
5,749,668 A * 5/1998 McIlvain et al. ..... 482/79
6,213,923 B1 4/2001 Cameron et al.
6,475,127 B1 11/2002 Koenig
6,533,710 B2 * 3/2003 Lin et al. ..... 482/123
6,599,255 B2 7/2003 Zhang
6,709,369 B1 3/2004 Jacobs
6,770,013 B2 * 8/2004 Stillinger ..... 482/91
7,115,081 B2 * 10/2006 Stearns ..... 482/140
7,329,213 B1 * 2/2008 Farley ..... 482/140

* cited by examiner

*Primary Examiner*—Loan H Thanh
*Assistant Examiner*—Allana Lewin
(74) *Attorney, Agent, or Firm*—The Webb Law Firm

(57) ABSTRACT

An improved stretching apparatus includes a movable back rest and a movable foot manipulator which, when employed together, can provide therapeutic stretching to the leg muscles of a subject. For instance, the improved device can stretch the calves, hamstrings, and other leg muscles. An improved method of employing a stretching apparatus to perform a therapeutic stretching operation on the leg muscles of a subject includes engaging a subject's outstretched legs with a foot manipulator of the stretching apparatus, engaging the subject's back with a back rest of the stretching apparatus, and pivoting the foot manipulator in a stretching direction to move the feet in a dorsal direction to provide stretching of at least some of the leg muscles. The method can additionally include returning the foot manipulator to its original position, incrementally moving the back rest to take up some of the muscular looseness created by the movement of the foot manipulator in the stretching direction, and again pivoting the foot manipulator in a stretching direction to perform an additional stretching operation.

10 Claims, 9 Drawing Sheets

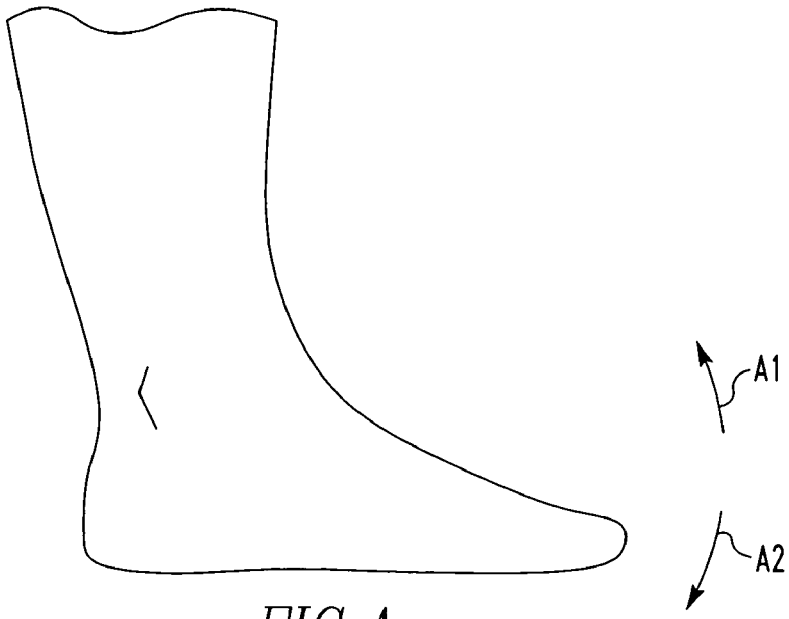
FIG.A
PRIOR ART
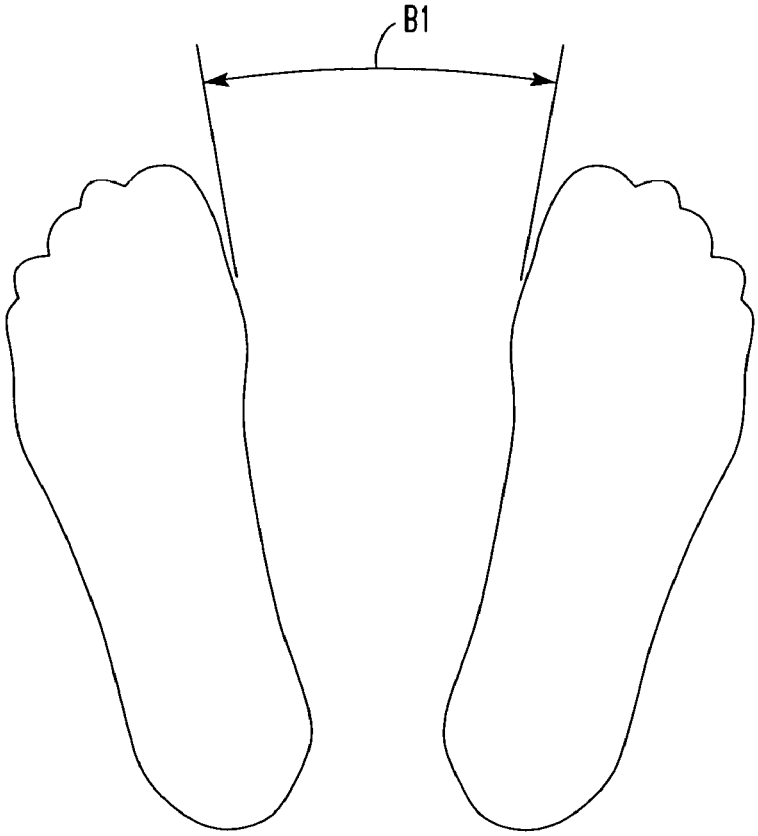
FIG.B
PRIOR ART

STRETCHING APPARATUS AND ASSOCIATED METHOD

BACKGROUND OF THE INVENTION

1. Field of the Invention

The invention relates generally to therapeutic machinery and, more particularly, to an apparatus for stretching the leg muscles of a subject.

2. Description of the Related Art

The desirability of having flexible muscles is well documented. The flexibility of a muscle typically is proportional to the strength or power of the muscle. As the relative flexibility of a person's muscles increases, the likelihood of injury to the person from day-to-day activities is correspondingly reduced. Increased muscular flexibility additionally provides for pain reduction and an increased range of motion, all of which are desirable.

A typical muscle includes layers of muscle tissue and layers of fascia tissue, with lubrication typically being provided between adjacent layers of muscle tissue and fascia tissue. As tissue ages, the tissue tends to shrink, i.e., shorten, and layers of muscle tissue can become adhered to adjacent layers of fascia tissue. That is, the lubrication between muscle tissue and adjacent fascia tissue can disappear, and the muscle tissue can, in effect, become fascia tissue. This is undesirable. Muscle tissue that has become fascia tissue cannot be stretched and cannot function as muscle tissue, and such gradual transformation of muscle tissue into fascia tissue is preferably avoided or at least slowed.

It is understood that stretching of muscles promotes flexibility by, for instance, increasing the degree of lubrication between muscle tissue and adjacent fascia tissue. Stretching also resists the transformation of muscle tissue into fascia tissue. Stretching is thus therapeutically desirable. However, many people's muscles are in a condition of being inadequately stretched, with resultant pain, loss of motion, and increased likelihood of injury. Some people do not perform any stretching exercises whatsoever. For other people, the stretching exercises performed may be inadequate or may be non-optimized, with the result that their muscles are inadequately stretched and of an undesirably low degree of flexibility. It thus would be desirable to provide an improved apparatus and method that can provide therapeutic stretching to enhance muscular flexibility and overall health of a subject.

It is also known that an excessive flare angle between the feet is undesirable. An excessive flare can cause difficulty in walking and accelerated degradation of the leg joints, particularly the hip joint, since the head of the femur often cannot sit properly in the acetabulum. Moreover, stretching of the leg muscles of a subject having an excessive foot flare often cannot be accomplished with a great degree of success since the leg muscles become misaligned with the leg joints during a stretch. That is, the muscles are not stretched over the leg joints and rather are stretched at least partially at the sides of the leg joints, with the result that the muscles cannot be adequately stretched. It thus would be desirable to provide an improved apparatus and method that can provide therapeutic stretching while at least partially overcoming the limitations resulting from an excessive foot flare.

SUMMARY OF THE INVENTION

An improved stretching apparatus includes a movable back rest and a movable foot manipulator which, when employed together, can provide therapeutic stretching to the leg muscles of a subject. For instance, the improved device can stretch the calves, hamstrings, and other leg muscles. An improved method of employing a stretching apparatus to perform a therapeutic stretching operation on the leg muscles of a subject includes engaging a subject's outstretched legs with a foot manipulator of the stretching apparatus, engaging the subject's back with a back rest of the stretching apparatus, and pivoting the foot manipulator in a stretching direction to move the feet in a dorsal direction to provide stretching of at least some of the leg muscles. The method can additionally include returning the foot manipulator to its original position, incrementally moving the back rest to take up some of the muscular looseness created by the movement of the foot manipulator in the stretching direction, and again pivoting the foot manipulator in a stretching direction to perform an additional stretching operation.

Accordingly, an aspect of the invention is to provide an improved stretching apparatus that provides therapeutic stretching to the leg muscles of a subject.

Another aspect of the invention is to provide an improved stretching apparatus for therapeutically increasing the flexibility of the leg muscles of a subject.

Another aspect of the invention is to provide an improved stretching apparatus that can correct excessive foot flare while still performing a stretching operation.

Another aspect of the invention is to provide an improved method of performing a therapeutic stretching operation on a subject.

Accordingly, an aspect of the invention is to provide an improved stretching apparatus that is structured to enable therapeutic stretching of at least some of the muscles of the upper legs and at least some of the muscles of the lower legs of a subject. The general nature of the stretching apparatus can be stated as including a frame, a chair apparatus disposed on the frame, and a foot manipulator. The chair apparatus includes a seat and a back rest. The seat is structured to receive thereon at least one of i) the subject's thighs, and ii) the subject's buttocks. The back rest is engageable with the subject's back and is movable to position the subject's back in a plurality of orientations with respect to the subject's thighs. The foot manipulator is engageable with the subject's feet when the subject's legs are substantially outstretched. The foot manipulator is movable between a first position and a second position to pivot the subject's feet in a dorsal direction about the subject's ankles. The subject's feet are in a generally relaxed position when the foot manipulator is in the first position. The subject's feet are in a dorsal position, and at least some of the muscles of the upper legs and at least some of the muscles of the lower legs are in an at least partially stretched condition when the foot manipulator is in the second position.

Another aspect of the invention is to provide an improved method of employing a stretching apparatus to perform a therapeutic stretching operation on the upper and lower leg muscles of a subject. The general nature of the method can be stated as including positioning the subject on a seat of the stretching apparatus, engaging the feet of the subject's outstretched legs with a foot manipulator of the stretching apparatus, engaging the subject's back with a back rest of the stretching apparatus, and pivoting at least a portion of the foot manipulator in a stretching direction to move the feet about the subject's ankles in a dorsal direction and to at least partially stretch at least some of the muscles of the upper legs and at least some of the muscles of the lower legs of the subject. The improved method may additionally include pivoting the at least a portion of the foot manipulator in a releasing direction substantially opposite the stretching direction, incrementally moving the back rest in a direction generally toward the at least a portion of the foot manipulator, and repeating the pivoting of the at least a portion of the foot manipulator in the stretching direction to move the feet about the subject's ankles in the dorsal direction and to at least partially stretch at least some of the muscles of the upper legs and at least some of the muscles of the lower legs of the subject.

BRIEF DESCRIPTION OF THE DRAWINGS

A further understanding of the invention can be gained from the following Description of the Preferred Embodiment when read in conjunction with the accompanying drawings in which:

FIG. A is a view of a foot in conjunction with various directions of motion;

Figure 1:
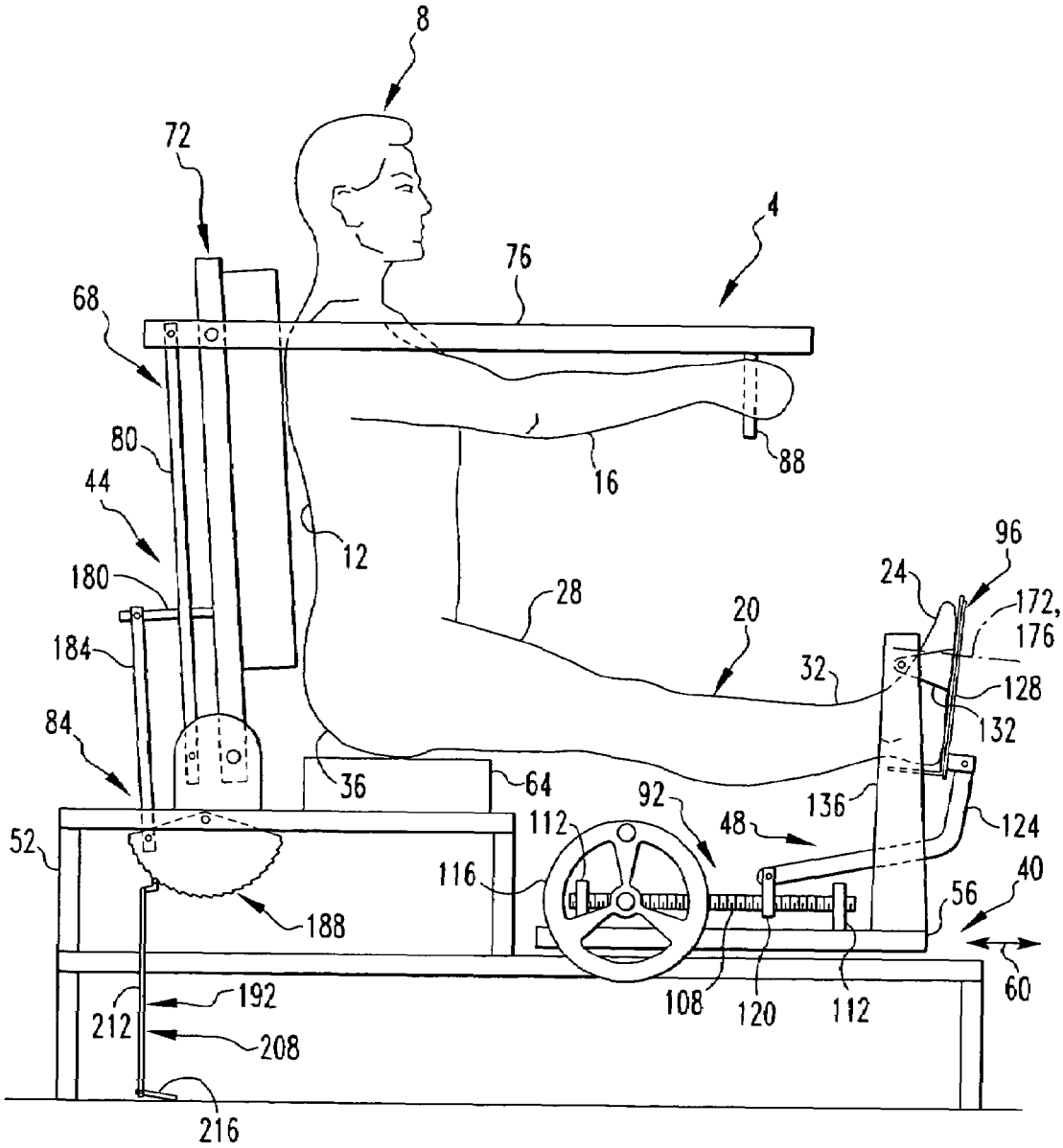
Figure 3:
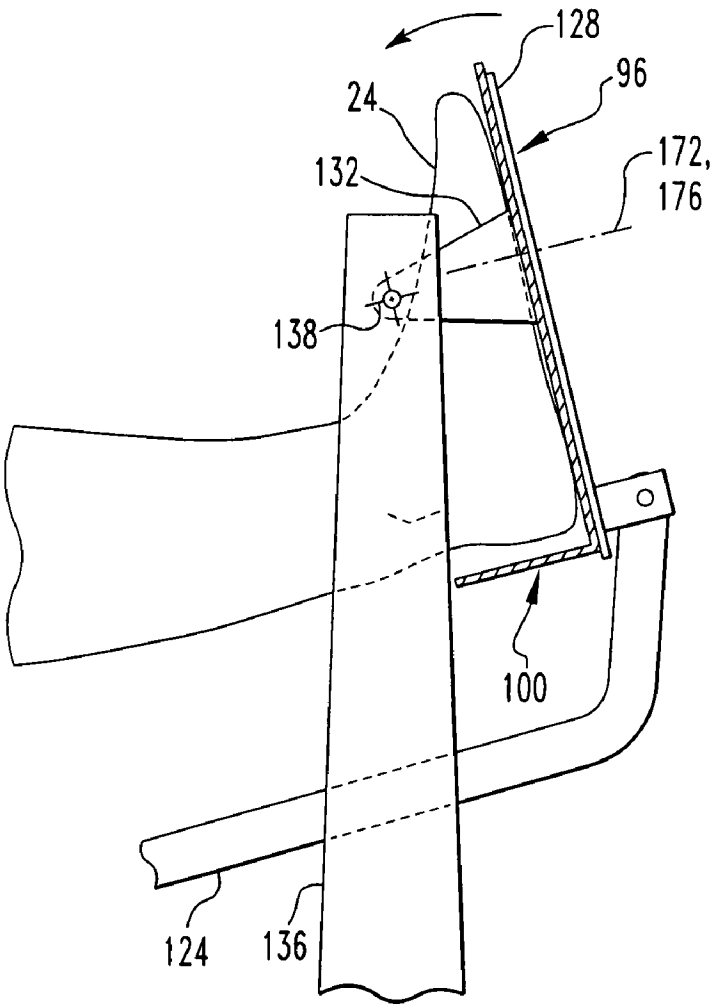
Figure 2:
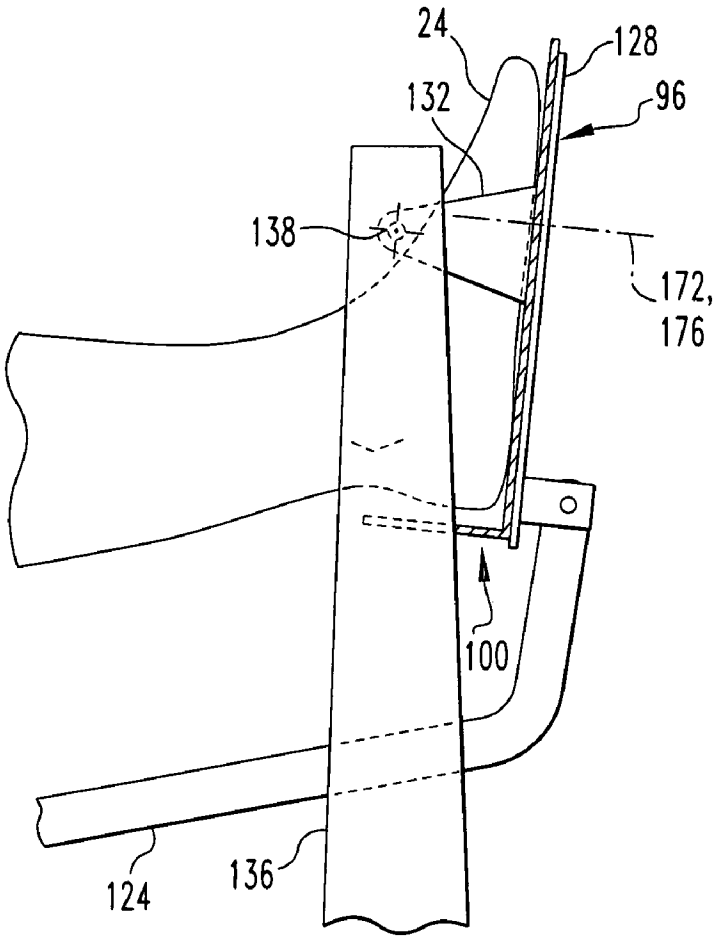
Figure 4:
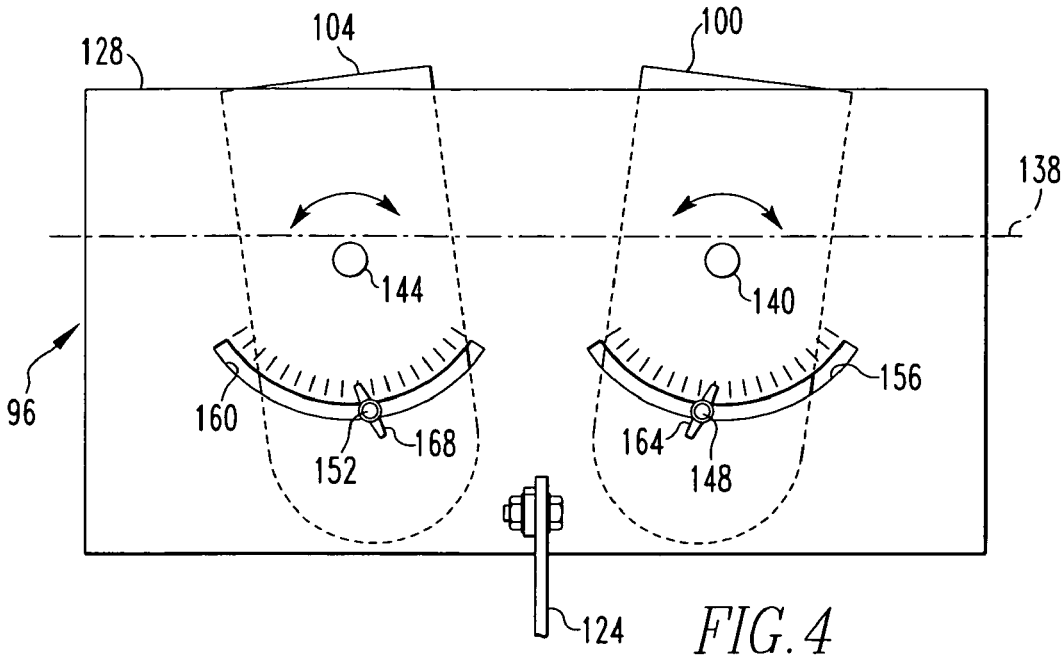
Figure 5:
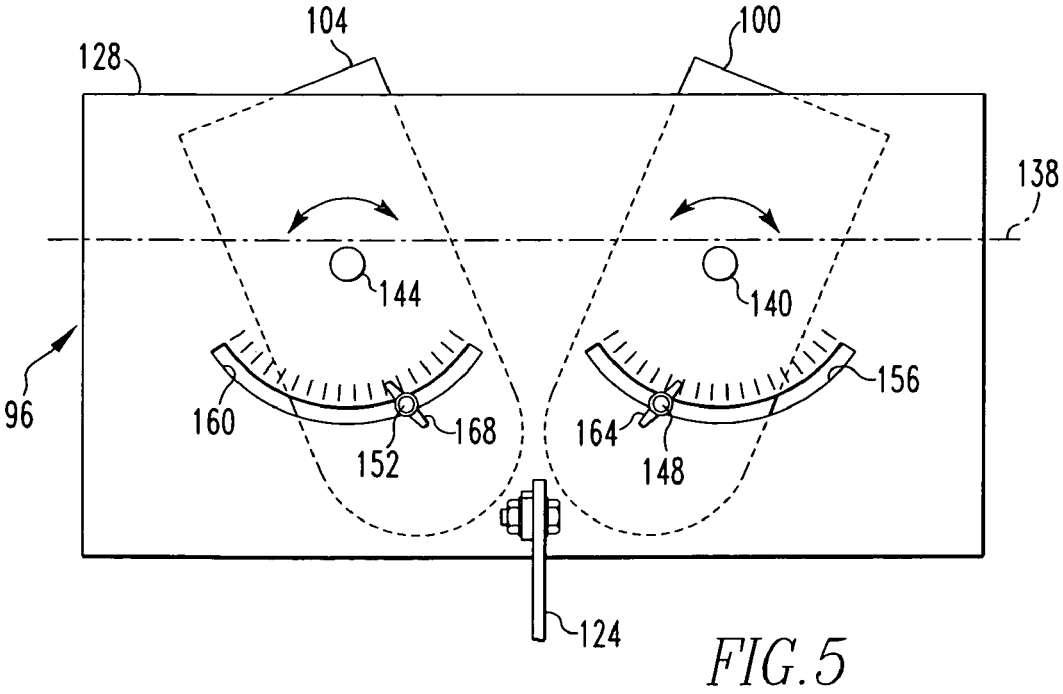
Figure 6:
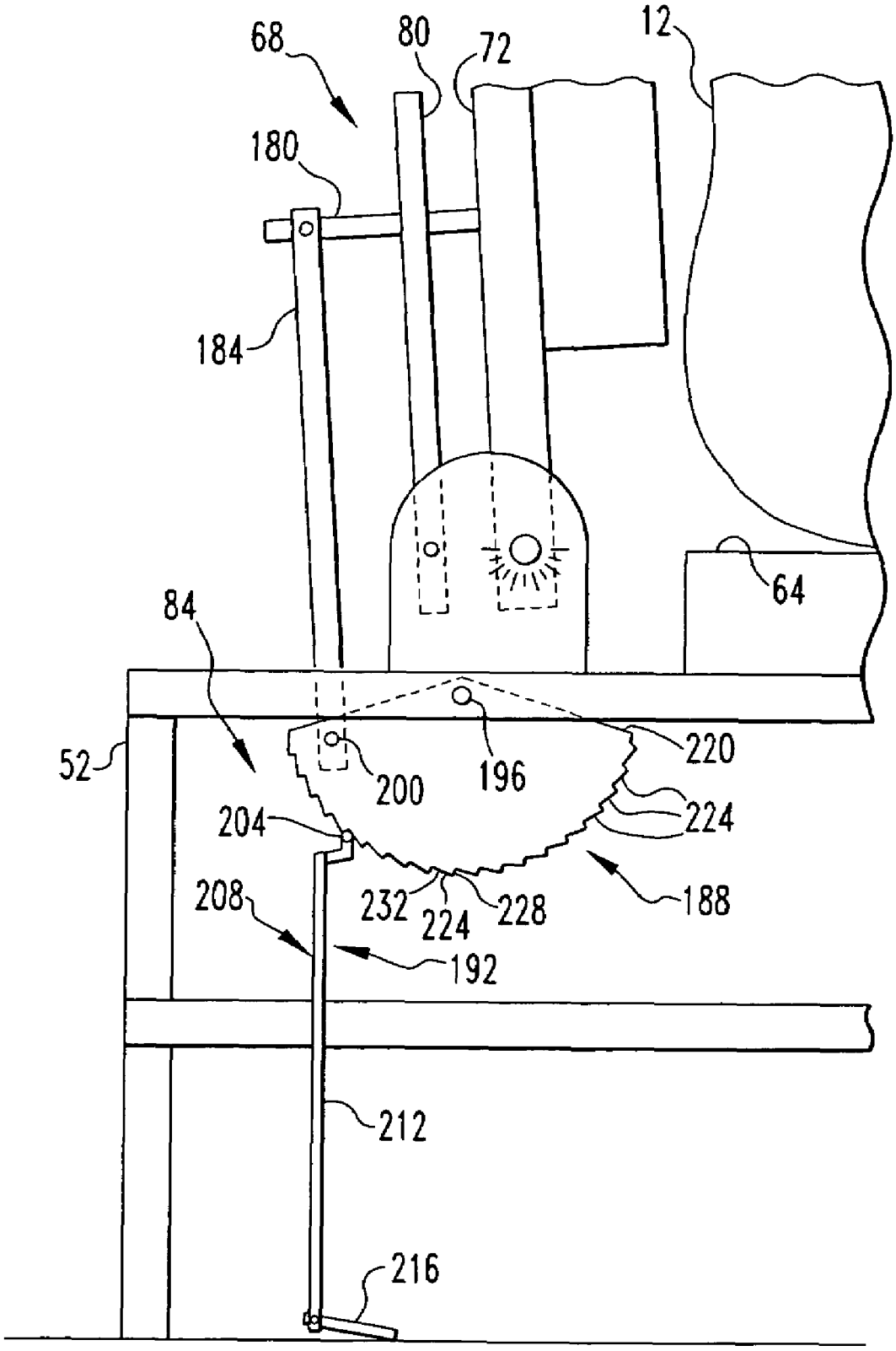
Figure 7:
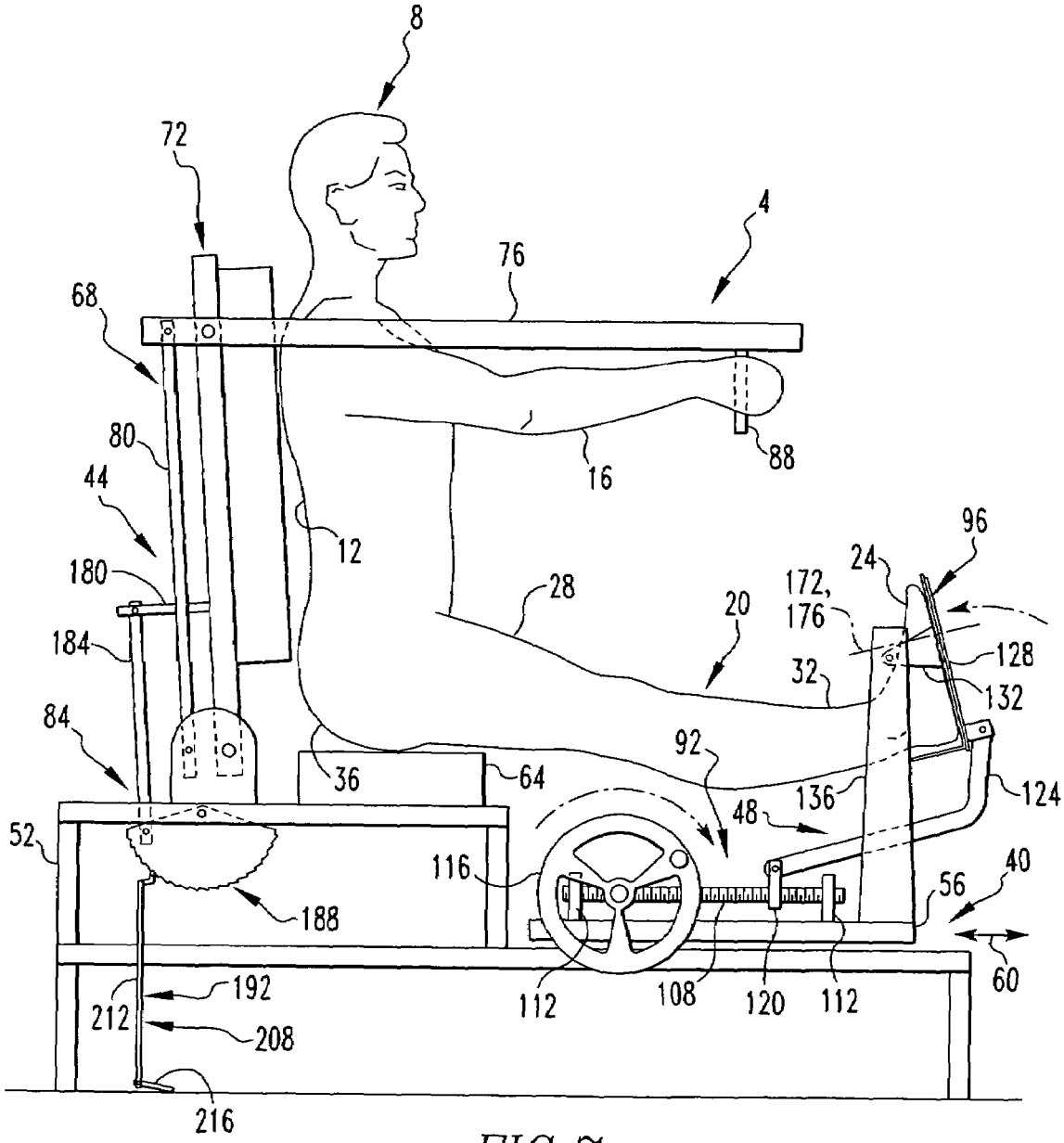
Figure 8:
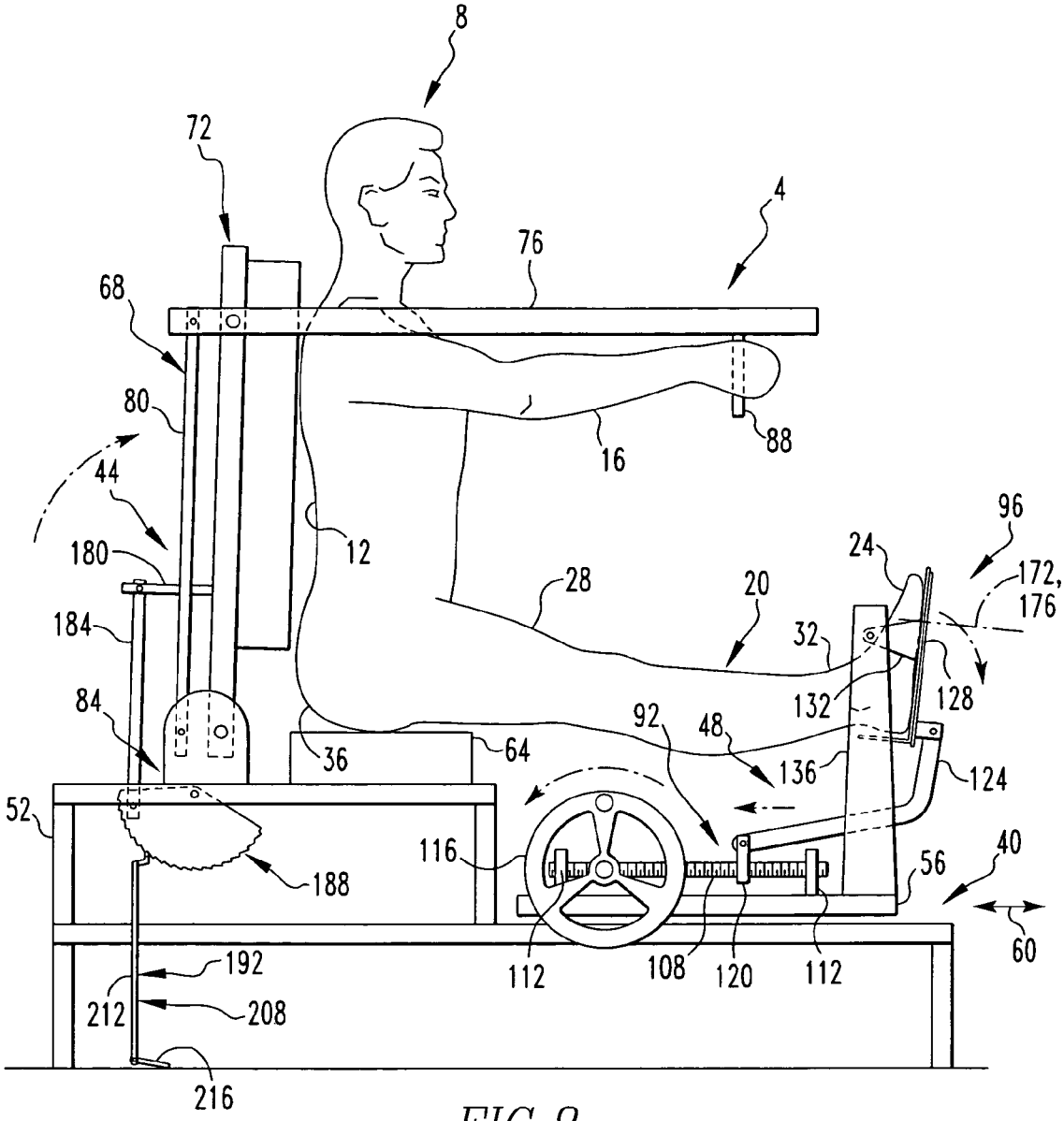
Figure 9:
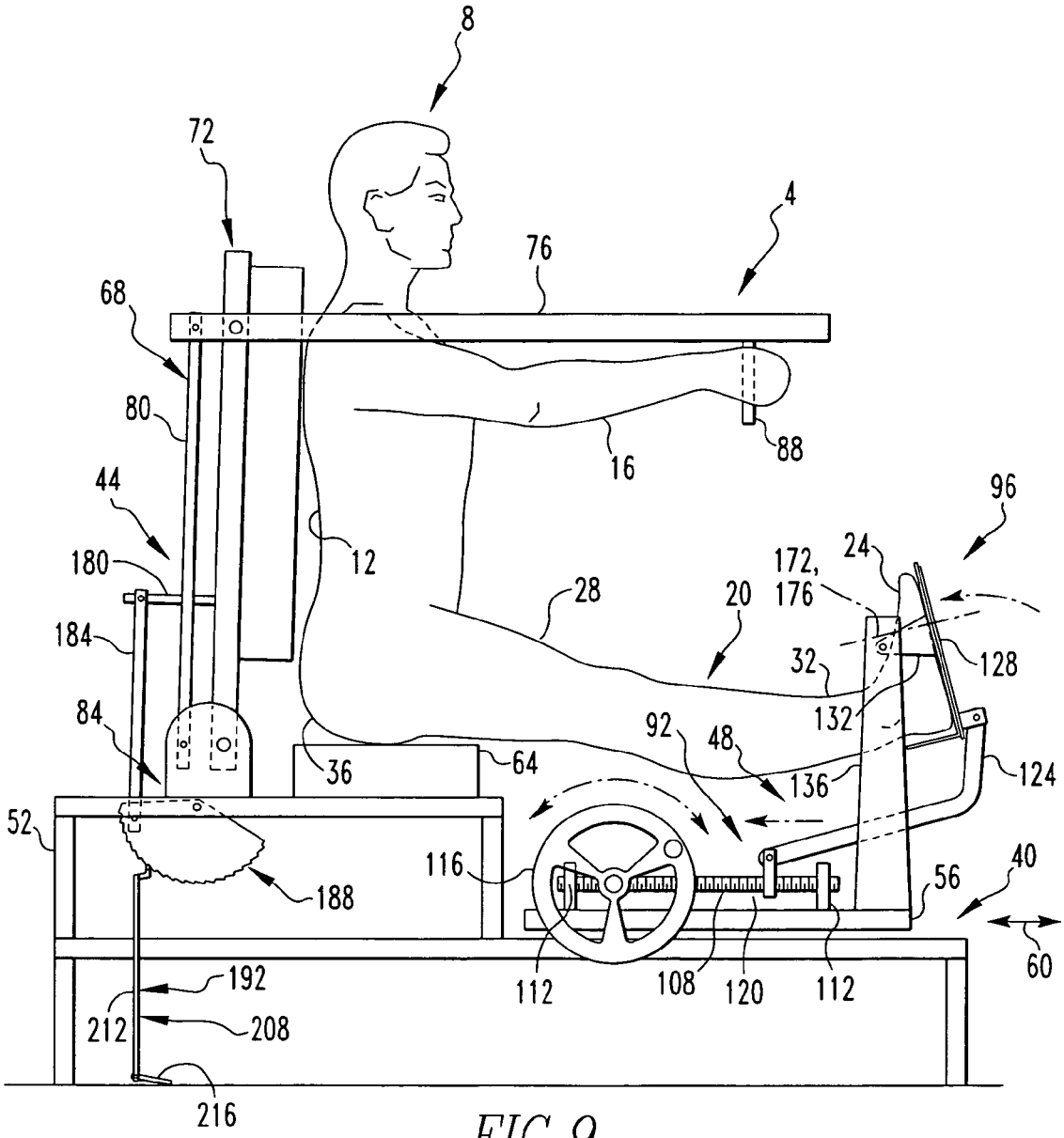
Figure 10:
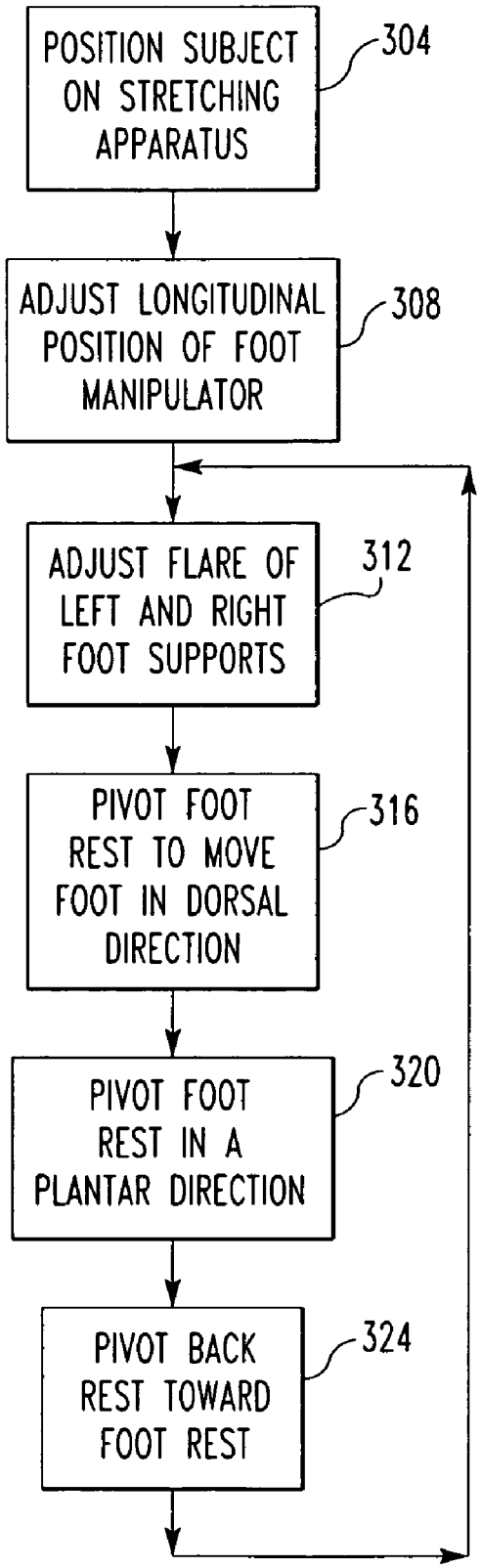

FIG. B is a view of a pair of feet and depicting a flare between the feet;

FIG. 1 is a schematic front elevational view of an improved stretching apparatus in accordance with the invention, and also depicts a portion of an improved method in accordance with the invention;

FIG. 2 is a cut away side view of a portion of the stretching apparatus of FIG. 1 in one position;

FIG. 3 is a view similar to FIG. 2, except depicting the portion of the stretching apparatus in another position;

FIG. 4 is a right side elevational view of a portion of a foot manipulator of the stretching apparatus of FIG. 1;

FIG. 5 is a view similar to FIG. 4, except depicting a pair of foot supports of the foot manipulator in a different position than depicted in FIG. 4;

FIG. 6 is an enlarged view of a portion of the stretching apparatus of FIG. 1;

FIG. 7 is a view of the stretching apparatus of FIG. 1, except depicting another portion of the method;

FIG. 8 is a view similar to FIG. 7, except depicting another portion of the method;

FIG. 9 is a view similar to FIG. 8, except depicting another portion of the method; and FIG. 10 is an exemplary flowchart depicting at least a portion of the improved method.

Similar numerals refer to similar parts throughout the specification.

DESCRIPTION OF THE PREFERRED EMBODIMENT

FIGS. A and B depict feet and are employed to describe certain terminology that will be employed herein in relation to the depicted feet. The exemplary feet are depicted as being human feet, it being understood that the teachings herein shall not be construed to be limited to a human subject. FIG. A depicts at the numeral A1 a direction of movement that will be referred to herein as being movement in a dorsal direction. In a general, movement of a foot in the dorsal direction will refer to movement of the front part of the foot that includes the toes in a direction generally toward the knee. Such movement in the foot in the dorsal direction typically will involve pivoting of the foot about the ankle. FIG. A similarly depicts at the numeral A2 movement in the plantar direction, which is a direction generally opposite the dorsal direction. Movement of a foot in the plantar direction typically will involve movement of the front of the foot that includes the toes in a direction generally away from the knee, and typically will involve pivoting of the foot about the ankle. FIG. B depicts a pair of feet with a flare therebetween that may be measured according to a flare angle B1 therebetween.

An improved stretching apparatus 4 in accordance with the invention is depicted in a schematic fashion in FIG. 1. The stretching apparatus 4 can be advantageously employed in conjunction with an improved method of the invention to perform a stretching operation on a subject 8. The exemplary subject 8 is a human subject having a back 12, a pair of arms 16, a pair of legs 20, and a pair of feet 24. The legs 20 include a pair of upper legs 28, i.e., thighs, and a pair of lower legs 32. The subject 8 additionally includes buttocks 36 generally at the point where the upper legs 28 meet the back 12. In accordance with the invention, the stretching apparatus 4 and the improved method of using the stretching apparatus 4 provide therapeutic stretching to muscles in the upper legs 28 and to muscles in the lower legs 32, such as might include the calves, hamstrings, and other muscles. It is understood that such muscles are exemplary only, and it is further understood that the improved stretching apparatus 4 and associated method can be employed to perform therapeutic stretching of additional and/or other muscles of the subject 8 without departing from the concept of the invention.

The stretching apparatus 4 includes a frame 40, a chair apparatus 44 disposed on the frame 40, and a foot manipulator 48 disposed on the frame 40. The frame 40 can be disposed, for example, on a floor or on other structures. As will be set forth in greater detail below, the subject 8 generally sits on the chair apparatus 44, and the foot manipulator 48 engages the outstretched legs 20 of the subject 8 to perform a therapeutic stretching operation thereon.

The frame 40 includes a first frame portion 52 upon which the chair apparatus 44 is disposed, and further includes a second frame portion 56 upon which the foot manipulator 48 is disposed. The second frame portion 56 is movable with respect the first frame portion 52. In the present exemplary embodiment, the second frame portion 56 is movably disposed on the first frame portion 52 and, more particularly, is longitudinally movable with respect to the first frame portion 52, as is indicated by the arrow 60 in FIG. 1.

As can further be seen in FIG. 1, the chair apparatus 44 includes a seat 64 and a back rest 68. The seat 64 is configured such that the subject 8 can sit thereon, whereby the subject's legs 20 and/or buttocks 36 are disposed on the seat 64.

The back rest 68 includes a back support 72, a pair of arms 76, at least a first parallel link 80, and a retention mechanism 84. The back support 72 is engageable with the back 12 of the subject 8 to retain the back 12 in a particular orientation with respect to the upper legs 28. The arms 76 are pivotably connected with the back support 72 and with the parallel link 80. The back support 72 and the parallel link 80 are both pivotably connected with the first frame portion 52. The back support 72 and the parallel link 80 together retain the arms 76 in a predetermined orientation with respect to first frame portion 52 independent of the orientation of the back support 72. In the present exemplary embodiment, the arms 76 are maintained in a substantially horizontal orientation. As will be described in greater detail below, the arms 76 include handgrips 88 that can be gripped by the subject 8 for various purposes and enable the subject 8 to pivot the back support 72 in a clockwise direction from the perspective of FIG. 1.

The foot manipulator 48 includes an operating mechanism 72 and a foot rest 96 operatively connected together. As will be set forth in greater detail below, the operating mechanism 92 is operable to pivot the foot rest 96 to perform a therapeutic stretching operation. As can be seen in FIGS. 4 and 5, the foot manipulator 48 additionally includes a right foot support 100 and a left foot support 104 disposed on the foot rest 96. The right and left foot supports 100 and 104 are, in the present exemplary embodiment, movable with respect to the foot rest 96, as will be set forth in greater detail below.

The operating mechanism 92 of the depicted exemplary embodiment includes an elongated threaded rod 108 that is mounted to the second frame portion 56 with a pair of pillow blocks 112, and further includes a wheel 116 that is operatively connected with the threaded rod 108 with a worm gear that is not expressly depicted herein. The operating mechanism 92 further includes a follower 120 that is threadably disposed on the threaded rod 108 and a link 124 that pivotably extends between the follower 120 and foot rest 96.

As can be understood from FIGS. 1-3, the foot rest 96 includes a main plate 128 and a pair of side plates 132, and the side plates 132 are depicted herein as being of a roughly triangular shape. The side plates 132 are disposed at opposite ends of the main plate 128 and are pivotably connected with a pair of vertical extensions 136 of the second frame portion 56. The main plate 128 thus is pivotable about a stretching axis 138 which extends perpendicularly into the plane of the page of FIGS. 2 and 3 and which is indicated by the crossed lines 138 in FIGS. 2 and 3. It is noted that the stretching axis 138 is spaced from the plane of the main plate 128.

FIGS. 2 and 3 generally depict the beginning and ending stages of an exemplary stretching operation. An exemplary stretching operation might begin with the foot rest 96 oriented in a position such as is depicted generally in FIG. 2. In such a position, the subject's feet 24 are at rest. By rotating the wheel 116, which in turn rotates the threaded rod 108, the follower 120 is caused to translate, which results in movement of the link 124. This causes pivoting of the foot rest 96 in a counter-clockwise direction from the perspective of FIGS. 2 and 3 to result in movement of the feet 24 in a dorsal direction. Such movement of the feet 24 in the dorsal direction performs a stretching operation on the muscles of the upper legs 28 and the muscles of the lower legs 32 in a therapeutic and beneficial fashion. Such a stretching operation is provided herein when the legs 20 are outstretched, i.e., when the legs 20 are substantially straight, it being noted that such a situation enables generally simultaneous stretching of the muscles of both the upper legs 28 and the lower legs 32. The degree of stretching, i.e., the angular distance between the first position depicted generally in FIG. 2 and the second position depicted generally FIG. 3, is dependent upon many factors including the desired amount of force that subject 8 is to experience, the age of the subject 8, the aggressiveness of the therapeutic procedure, and other factors.

As can be understood from FIG. 4, the right and left foot supports 100 and 104 are each independently pivotably disposed on the foot rest 96 and are lockable thereto in desired orientations. The right and left foot supports 100 and 104 are each pivotably mounted to the main plate 128 with a pivot pin 140 and 144. The right and left foot supports 100 and 104 each additionally include a locking pin 148 and 152 that slidably extends through a flare adjustment slot 156 and 160. The right and left foot supports 100 and 104 further each include a lock member 164 and 168 that is disposed on the locking pin 148 and 152. The lock members 164 and 168 can be employed to selectively and independently lock the right and left foot supports 100 and 104 in desired orientations with respect to the main plate 128. The right foot support 100 is pivotable about a first axis 172 (FIGS. 1-3) that extends perpendicularly into the plane of the page of FIG. 4 and is indicated by the crossed lines 172. The left foot support 104 is pivotable about a second axis 176 that extends perpendicularly into the plane of the page of FIG. 4 and is indicated by the crossed lines 176. The first axis 172 and the second axis 176 are oriented substantially parallel with one another and are each oriented substantially perpendicular to and spaced from the stretching axis 138, although other orientational relationships between the first axis 172, the second axis 176, and the stretching axis 138 can be employed without departing from the concept of the invention.

FIG. 4 depicts the right and left foot supports 100 and 104 locked to the main plate 128 at a relatively minor flare angle therebetween, which is depicted in FIG. 4. as being about 15°. A relatively more excessive flare between the right and left foot supports 100 and 104 is depicted generally in FIG. 5. The flare between the right and left foot supports 100 and 104 is depicted in FIG. 5 as being about 50°. The ability of the right and left foot supports 100 and 104 to be pivotable and lockable with respect to the main plate 128 enabled the correction of an excessive foot flare and also enables optimization of a stretching operation as will be described in greater detail below.

The retention mechanism 84 is depicted in greater detail in FIG. 6. The retention mechanism 84 includes a brace 180 affixed to the back support 72, a toothed crank 188 pivotably disposed on the first frame portion 52 with a mounting pivot 196, a connecting rod 184 extending between the brace 180 and the toothed crank 188, and a dog mechanism 152. The connecting rod 184 is pivotably connected with the toothed crank 188 at a connecting pivot 200 and is also pivotably connected with the brace 180. The retention mechanism 84 is advantageously configured to enable the subject 8 to manually move the back support 72 in the clockwise direction from the perspective of FIG. 6 merely by pressing on the hand grips 88. The retention mechanism 84 additionally is configured to resist movement of the back support 72 in a counter-clockwise direction from the perspective of FIG. 6 unless the dog mechanism 192 has been disengaged.

The dog mechanism 192 includes a dog 204 and a release mechanism 208 (FIG. 1). The release mechanism 208 biases the dog 204 in a direction generally toward the toothed crank 188. The release mechanism 208 additionally includes a connector 212 extending from the dog 204 and a release pedal 216 connected to the connector 212 opposite the dog 204.

The toothed crank 188 includes a crank 220 upon which a plurality of teeth 224 are formed. Substantially each tooth 224 includes a retention surface 228 and a transition surface 232. The dog 204 is engageable between the retention surface 228 of one tooth 224 and the transition surface 232 of an adjacent tooth 224. The engagement of the dog 204 with the retention surface 228 resists movement of the toothed crank 188 and thus of the back support 72 in a counter-clockwise direction from the perspective of FIG. 6. By stepping on the release pedal 216, the connector 212 is caused to overcome the bias of the dog 204 toward the toothed crank 188 to disengage the dog 204 from the retention surface 228 with which it had been engaged and to permit movement of the back support 72 in the counter-clockwise direction from the perspective of FIG. 6.

It is noted, however, that the dog mechanism 192 does not resist movement of the back support 72 in the clockwise direction from the perspective of FIG. 6, and rather permits such movement. When the subject 8 presses the hand grips 88 in a direction toward the right of FIG. 1, the force of such movement is transmitted through the brace 180 and the connecting rod 184 to the toothed crank 188. Such force on the toothed crank 188 causes it to pivot in the clockwise direction from the perspective of FIG. 6. Such clockwise pivoting of the toothed crank 188 causes the dog 204 to ride along the transition surface 232 and away from the retention surface 228 with which the dog 204 had previously been engaged. It thus can be seen that the release mechanism 208 is configured to permit movement of the back support 72 in a direction generally toward the foot rest 96 while resisting movement of the back support 72 in a direction generally away from the foot rest 96. The subject 8 thus can easily readjust the back support 72 in a direction generally toward the foot rest 96.

Therapeutic stretching of the subject 8 in accordance with aspects of the method of the invention is described below. The method typically may start with the subject 8 being disposed on the seat 64 with the outstretched legs 20 of the subject 8 being engaged with the right and left foot supports 100 and 104 of the foot manipulator 48. The second frame portion 56, which carries the foot manipulator 48 as a discrete unit, may need to be translated in the longitudinal direction 60 to accommodate the particular length of the subject's outstretched legs 20. In such a. position, the feet 24 of the user may be at a relaxed position, meaning that the feet 24 have not yet been moved in either the dorsal or plantar directions. The back support 72 may be pivoted in the clockwise direction until it contacts the back 12 of the subject 8.

The right and left foot supports 100 and 104 may also be pivotably positioned on the main plate 128 and locked thereon in a desirable position that may be based at least in part upon the existing foot flare between the subject's feet 24. Depending upon the course of therapy, the right and left foot supports 100 and 104 may be positioned to correspond with the existing foot flare of the subject 8, or the right and left foot supports 100 and 104 may be positioned at a flare different than the existing flare between feet 24 of the subject 8 for the purpose of correcting the foot flare and/or optimizing a stretching operation, as will be described in greater detail below.

The situation described in the preceding two paragraphs is depicted generally in FIG. 1. The operating mechanism 92 can thereafter be operated to perform a stretching operation on the muscles of the upper and lower legs 28 and 32 of the subject 8. Specifically, the wheel 116 can be rotated to cause a corresponding rotation of the threaded rod 108 and a translation of the follower 120 and the link 124 in a direction to the right of FIG. 1. Such motion will be transferred to the foot rest 96 in a fashion that will cause the main plate 128 to pivot in a counter-clockwise direction with respect to FIG. 1 about the stretching axis 138. This causes the feet 24 to be moved in the dorsal direction and performs a stretching operation on the muscles of the upper and lower legs 28 and 32. Once the foot rest 96 has been pivoted from the first position depicted generally in FIG. 1 to a desirable second, pivoted position, the rotation of the wheel 116 can be halted and the pivoting of the foot rest 96 similarly halted. This is the situation depicted generally in FIG. 7. The foot rest 96 may be maintained in the position depicted generally in FIG. 7 for a certain period of time to continue the stretching of the muscles of the upper and lower legs 28 and 32.

The muscles in the legs 20 that are being stretched by such operation can be considered to operate as a muscular system that extends generally between the heels of the subject 8 and the lower portion of the back 12. In this regard, the positioning of the right and left foot supports 100 and 104 at a desirable flare setting prior to such stretching operation can be appreciated. In the situation of an excessive foot flare, such as is depicted generally in FIG. 5, the muscular system that extends between the heels and the lower back does not extend directly along the rear of the legs 20. Rather, an excessive flaring of the toes in the outboard direction causes a positioning of the heels in an inboard direction, whereby the muscular system attached at the heel similarly is in an inboard position with respect to the ankle. During the course of a stretching operation whereby the foot is pivoted about the ankle, the muscular system of the excessively flared foot cannot be stretched in an optimized fashion since the muscular system is offset in an inboard direction from, for instance, the ankle. Any such stretching results in movement of the muscular system in a direction generally to the side of the ankle, for instance, rather than being stretched over the rear of the ankle. By progressively correcting the flare between the feet 24 by progressively positioning the right and left foot supports 100 and 104 closer and closer to the desired foot flare, the muscular system attached at the heel is gradually moved to a position at the rear of the ankle, such that when a stretching operation is performed and the feet are pivoted about the ankle, the muscular system attached at the ankle is stretched fully about the ankle, which optimizes such a stretching operation. Such correction of an excessive foot flare can also desirably cause the head of the femur to engage the acetabulum. In this regard, a trained practitioner can determine the course of treatment that is preferable for the subject 8.

Upon the completion of the first stretching operation, such as is depicted generally in FIG. 7, the wheel 116 can be rotated in an opposite direction to return the foot rest 96 to a position such as that depicted generally in FIGS. 1 and 2 where the feet 24 are in a relaxed position. Such pivoting of the foot rest 96 moves the feet 24 in a plantar direction. Since the system of leg muscles between the heels and the lower back has been at least incrementally loosened, the back support 72 can be moved in a direction generally toward the foot rest 96, which is the situation depicted generally in FIG. 8. Such movement of the back support 72 can be accomplished manually by the subject 8 pressing on the hand grips 88 or can be accomplished by other means, i.e., through the use of an automated mechanism or with the assistance of a therapist. Such movement of the back support 72 in a direction generally toward the foot rest 96 is highly desirable since the aforementioned stretching operation has at least incrementally stretched the muscles of the legs 20, and the stretched muscles of the legs 20 thus have a certain degree of looseness. Such looseness can be taken up like slack in a rope by maintaining the legs 20 in the outstretched condition and by pivoting the back support 72 in a direction generally toward the foot rest 96. In this regard, it is noted that the ankles of the subject 8 have only a limited range of motion. The muscles of the legs 20 typically can be stretched to a far greater degree than the range of motion of the ankles alone would permit. As such, the stretching apparatus 4 and the accompanying method provided herein provide incremental stretching operations whereby the feet 24 are pivoted in a dorsal direction to provide incremental stretching of the muscles of the legs 20 generally within the range of motion of the ankles. After each such incremental stretching operation, the foot rest 96 can be returned to its original position and the back support 72 can be pivoted toward the foot rest 96 to take up some of the looseness in the muscles of the legs 20 generated as a result of the stretching operation. With such incremental "slack" in the muscles being taken up by pivoting of the back support 72, the foot rest 96 can again be pivoted by operation of the operating mechanism 92 to perform an additional incremental stretching operation on the muscles of the legs 20. This is the situation depicted generally in FIG. 9.

Since the range of motion of the ankles is less than the capacity of the leg muscles to be stretched, stretching of the leg muscles is performed in incremental stretching operations by pivoting feet 24 about the ankles within the range of motion of the ankles. After such incremental stretching, the feet 24 are released and the "slack", i.e., looseness in the muscles of the legs 20, is taken up by pivoting the back support 72 in a direction generally toward the foot rest 96 while maintaining the legs 20 outstretched. Successive incremental stretchings of the leg muscles can be performed with additional pivotings of the feet 24, with subsequent release of the foot rest 96 and pivoting of the back support 72 in a direction toward the foot rest 96 after each such stretching operation. The flare between the subject's feet 24 can be adjusted to optimize such stretching operations in the manner mentioned above.

Certain portions of the improved method of the invention are depicted generally in the flowchart shown in FIG. 10. For example, the subject 8 may be positioned, as at 304, on the seat 64 of the stretching apparatus 4. The foot manipulator 48 may then be longitudinally adjusted, as at 308, to enable the left and right foot supports 100 and 104 to engage the feet 24 of the outstretched legs 20 of the subject 8. The right and left foot supports 100 and 104 can then be positioned, at 312, to adjust the flare therebetween.

The foot rest 96 can then be pivoted, as at 316, by operation of the operating mechanism 92 to pivot the feet 24 in the dorsal direction to perform a stretching operation. Thereafter, the foot rest 96 can be pivoted, as at 320, in an opposite direction, i.e., in the plantar direction, to release the tension on the muscles of the upper and lower legs 28 and 32. The back support 72 can then be pivoted, as at 324, in a direction generally toward the foot rest 96 to take up some of the looseness that has been provided in the muscles of the legs 20. Treatment can thereafter continue, as at 312, where the flare between the right and left foot supports 100 and 104 can be readjusted, if desired, with subsequent pivoting in the dorsal direction as at 316, pivoting in the plantar direction as at 320, and pivoting of the back support 72 toward foot rest 96 as at 324.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A stretching apparatus structured to enable therapeutic stretching of at least some of the muscles of the upper legs and at least some of the muscles of the lower legs of a subject, the stretching apparatus comprising:

a frame;

a chair apparatus disposed on the frame, the chair apparatus including a seat and a back rest, the seat being structured to receive thereon at least one of:

the subject's thighs, and the subject's buttocks;

the back rest being engageable with the subject's back, the back rest being movable to position the subject's back in a plurality of orientations with respect to the subject's thighs; and a foot manipulator engageable with the subject's feet when the subject's legs are substantially outstretched, the foot manipulator being movable between a first position and a second position to pivot the subject's feet in a dorsal direction about the subject's ankles, the subject's feet being in a generally relaxed position when the foot manipulator is in the first position, the feet being in a dorsal position and at least some of the muscles of the upper legs and at least some of the muscles of the lower legs being in an at least partially stretched condition when the foot manipulator is in the second position, wherein the back rest is pivotable with respect to the seat, wherein the back rest includes a retention mechanism, the retention mechanism resisting movement of the back rest in a first direction generally away from the foot manipulator while permitting movement of the back rest in a second direction generally toward the foot manipulator, and wherein the retention mechanism includes a toothed crank and a dog, the toothed crank including a crank and a plurality of teeth disposed on the crank, the dog being biased toward the toothed crank and being engageable with a tooth of the plurality teeth, the dog engaged with the tooth resisting pivoting of the back rest in the first direction, movement of the back rest in the second direction overcoming the bias of the dog.

2. The stretching apparatus of claim 1 wherein the back rest is pivotable with respect to the seat and includes at least one handgrip operatively connected to the backrest so as to be located in a forward location with respect to the subject's back in order to facilitate pivoting of the backrest in a direction toward the foot manipulator.

3. The stretching apparatus of claim 1 wherein at least a portion of the foot manipulator is pivotable about a stretching axis between the first and second positions, the stretching axis being substantially perpendicular to the dorsal direction.

4. The stretching apparatus of claim 3 wherein the foot manipulator includes a foot rest, the foot rest including a plate that is engageable with the soles of the subject's feet when the subject's legs are substantially outstretched, the plate being pivotable between the first and second positions, the stretching axis being spaced from the plane of the plate.

5. The stretching apparatus of claim 3 wherein the foot manipulator includes a pair of foot supports that are movable with respect to one another.

6. The stretching apparatus of claim 5 wherein the pair of foot supports include a right foot support and a left foot support, the right foot support being engageable with the subject's right foot and being pivotable about a first axis, the left foot support being engageable with the subject's left foot and being pivotable about a second axis, the first axis and the second axis being substantially parallel with one another and being substantially perpendicular to the stretching axis.

7. The stretching apparatus of claim 6 wherein the foot manipulator includes a foot rest, the right and left foot supports each being lockable in a predetermined position with respect to the foot rest.

8. The stretching apparatus of claim 1 wherein the foot manipulator includes a foot rest and an operating mechanism operatively connected together, the operating mechanism being operable to move the foot rest between the first and second positions.

9. The stretching apparatus of claim 8 wherein the frame includes a first frame portion and a second frame portion, the second frame portion being movably disposed on the first frame portion, one of the chair apparatus and the foot manipulator being disposed on the first frame portion, the other of the chair apparatus and the foot manipulator being disposed on the second frame portion.

10. The stretching apparatus of claim 1 wherein the back rest includes a number of handgrips which are structured to be gripped by the subject when leaning forward to pivot the back rest in the second direction.

* * * * *